US007185580B2

(12) United States Patent
Schwarz et al.

(10) Patent No.: US 7,185,580 B2
(45) Date of Patent: Mar. 6, 2007

(54) FLUID-ACTUATED CONTRACTION DRIVE AND ASSOCIATED CONTRACTION TUBE

(75) Inventors: Stefan Schwarz, Altdorf (DE); Bernd Lorenz, Baltmannsweiler (DE)

(73) Assignee: Festo AG & Co., Esslingen (DE)

( * ) Notice: Subject to any disclaimer, the term of this patent is extended or adjusted under 35 U.S.C. 154(b) by 8 days.

(21) Appl. No.: 10/503,951

(22) PCT Filed: Apr. 3, 2003

(86) PCT No.: PCT/EP03/03458

§ 371 (c)(1),
(2), (4) Date: Aug. 9, 2004

(87) PCT Pub. No.: WO03/087587

PCT Pub. Date: Oct. 23, 2003

(65) Prior Publication Data

US 2005/0076778 A1 Apr. 14, 2005

(30) Foreign Application Priority Data

Apr. 12, 2002 (DE) ..... 202 05 654 U

(51) Int. Cl.
*F01B 19/00* (2006.01)

(52) U.S. Cl. ..... 92/92

(58) Field of Classification Search ..... 92/90, 92/91, 92

See application file for complete search history.

(56) References Cited

U.S. PATENT DOCUMENTS 2,844,126 A * 7/1958 Gaylord ..... 92/90
3,084,961 A * 4/1963 Merriman ..... 92/92
4,513,997 A * 4/1985 Garlapaty ..... 285/242
4,664,232 A * 5/1987 Takagi et al. ..... 92/90
4,819,547 A * 4/1989 Kukolj ..... 92/92
4,841,845 A * 6/1989 Beullens ..... 92/92
5,031,510 A * 7/1991 Krauter ..... 92/92
5,512,153 A * 4/1996 Day et al. ..... 204/196.33
6,279,933 B1 * 8/2001 Ross et al. ..... 280/149.2

FOREIGN PATENT DOCUMENTS

| | | |
|---|---|---|
| DE | 27 11 699 | 9/1978 |
| DE | 28 02 716 | 7/1979 |
| EP | 0 161 750 | 11/1985 |
| GB | 2 328 981 A | 3/1999 |
| GB | 2 335 467 A | 9/1999 |
| WO | 00/61952 | 10/2000 |

* cited by examiner

*Primary Examiner*—Michael Leslie
(74) *Attorney, Agent, or Firm*—Hoffmann & Baron, LLP

(57) ABSTRACT

A fluid power contractile drive comprising a contractile hose (2), which on fluid actuation of an actuation space (7) delimited by it undergoes longitudinal contraction and which at its two terminal regions (5 and 6) is adapted to be, or is, provided with a force output means (8) rendering possible output of the drive force produced. At one terminal region (5 and 6) at least the contractile hose (2) possesses a flat configuration and is bent over, the hose sections (18 and 19) of the hose sections being placed adjacent to each other owing to such bending over being connected firmly with each other.

19 Claims, 2 Drawing Sheets

FLUID-ACTUATED CONTRACTION DRIVE AND ASSOCIATED CONTRACTION TUBE

FIELD OF THE INVENTION

The invention relates to a fluid power contractile drive comprising a contractile hose, in the case of which when there is a fluid actuation of an actuation space delimited by it a longitudinal contraction thereof takes place and which at its two terminal regions is adapted to be, or is, provided with a force output means rendering possible output of the drive force produced. Furthermore, the invention relates to a contractile hose for a fluid power contractile drive.

BACKGROUND OF THE INVENTION

The patent publication WO 00/61952 A1 and the European patent publication 0 161 750 B1 each disclose a fluid power contractile drive, which comprises a contractile hose, which at its end has a force output means attached to it. The contractile hose comprises a rubber elastic hose body and a tensile fiber arrangement coaxial to it. If the actuation space delimited by the contractile hose is filled with a fluid pressure medium subject to a certain operating pressure, the contractile hose will be subject to a radial spread accompanied by an axial longitudinal contraction. Accordingly tension forces will be exerted on the force output means so that same are acted upon to produce a mutual movement toward one another. It is in this manner that external structures and components, which are secured to the force output means, may be braced together and/or moved in relation to one another.

SUMMARY OF THE INVENTION

More particularly in the case of actuation with a high operating pressure it is a problem to ensure a reliable seal and a reliable transmission of force at the terminal regions to the force output means. Accordingly one object of the present invention is to provide a fluid power contractile drive and a contractile hose for a fluid power contractile drive, in the case of which such problems no longer occur or are at least less severe.

This object is to be achieved in the case of a fluid power contractile drive of the type initially mentioned since the contractile hose has a flat configuration at least at one terminal region and is bent over, the hose sections arranged adjacent to each other owing to the bending of the hose sections of the contractile hose being firmly connected with each other.

Moreover the object is attained in the case of a contractile hose of the type initially mentioned which is characterized in that at one terminal region at least it has a flat configuration and is bent over, the hose sections, arranged adjacent to each other owing to the bending, being firmly connected together.

Owing to the bending over of the respective terminal region of the contractile hose in conjunction with the flat configuration thereof the hose ends may be extremely simply and reliably sealed. More especially at the point of bending over a reliable seal may be produce owing to the change in direction. However by thrusting the oppositely placed parts of the hose wall together it is also possible to encourage a reliable sealing action. At any rate the bent over terminal region is highly suitable for reliably anchoring a force output means rendering possible the output of the drive force produced.

Further advantageous developments of the invention are defined in the dependent claims.

Preferably the adjacently placed hose sections make flat contact with each other, same being more particularly firmly thrust together.

The firm connection of the adjacently placed hose sections may for example be produced by a bond, a weld or a sewn joint, although however pining together of the hose sections using at least one connection pin, extending through them, is possible as well. These types of connection may be combined with each other in any desired way.

At least one connecting pin present, for instance in the form of a screw or a rivet, can also be a component of the associated force output means or constitute same. In this connection it is an advantage if at least one pin has a screw thread, which may be secured to the structure to be braced or moved or, respectively, as part of a screw connection.

The contractile hose preferably consists of a hose body with rubber elastic properties, in whose wall a tensile fiber arrangement is coaxially embedded. The tensile fiber arrangement may also be seated at the outer periphery of the hose body. Preferably, the tensile fiber arrangement consists of a plurality of crossed over tensile fibers having a high tensile strength and also flexible properties. Owing to the flexibility the bending over of the contractile hose is not hindered at the respective terminal region.

In the following the invention will be described with reference to the accompanying drawings in detail.

DETAILED DESCRIPTION OF THE PREFERRED EMBODIMENTS

Figure 1:
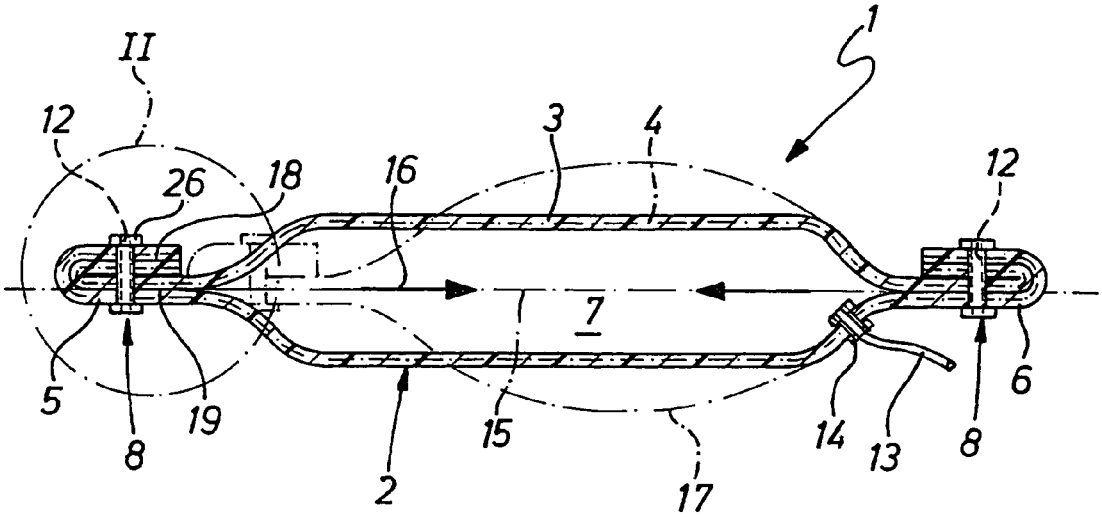
FIG. 1 is a longitudinal sectional representation of a preferred first design of the contractile drive in accordance with the invention.

The drawing shows a fluid power contractile drive generally referenced 1. It may be operated by a liquid or more preferably with a gaseous medium.

An important part of the contractile drive 1 is a hose-like membrane element referred to 2, which consists essentially of a hose body 3 of rubber elastic material and a tensile fiber arrangement 4 arranged coaxially in relation to the hose body. The tensile fiber arrangement 4 may surround the hose body like a stocking. It is preferably embedded in the wall of the hose body so that together with it constitutes a hose-like component.

At its two terminal regions 5 and 6 the contractile hose 2 is sealed off in a fluid-tight manner. Accordingly it delimits an elongated actuation space which is hermetically sealed off from the surroundings.

At each terminal region 5 and 6 a force output means 8 is secured. Same is provided with force output means 12 with which structures to be braced together or to be moved may be directly or indirectly secured. In the case of the working examples the force output means 12 are constituted by one or more threads, which render possible a screw attachment of the above mentioned components.

In the deactivated initial state, which is illustrated in full lines in FIG. 1, the force output means arranged at the two terminal regions 5 and 6 are at the maximum distance apart.

The contractile hose 2 possesses a certain initial length. The actuation space 7 is free of pressure.

For the activation of the contractile drive 1 the actuation space 7 is filled with a fluid pressure medium subject to predetermined actuation pressure. This pressure medium may be supplied by way of a fluid duct 13 communicating with the actuation space 7. In the working embodiment the supply of the fluid takes place through the wall of the hose body 3, which for this purpose is provided with suitable connection means 14. It would however also be possible to produce, more particularly in the case of a gas-powered contractile drive, the drive gas in the interior of the actuation space using a pyrotechnical means (not illustrated).

On activation the actuation space 7 is acted upon by an interior pressure so that contractile hose 2 is spread out radially. This radial spread is accompanied by an axial shortening of the hose length. Accordingly the force output means 8 are pulled together.

The cause of this behavior is the particular structure of the contractile hose 2, more particularly in conjunction with the above mentioned tensile fiber arrangement 4. The tensile fiber arrangement 4 has, in the working embodiment, a plurality of tensile fibers which are separate or arranged in strands, and which are crossed over or reticulated. In the radial direction as related to the longitudinal axis 15 of the contractile drive 1, the tensile fiber arrangement more particularly constitutes a grid-like structure. In the case of the radial spread or widening of the hose body 3 the grid angles change so that owing to contractile hose 2 a tension force is engendered at the terminal regions 5 and 6. Such tension force, whose direction is indicated by arrows 16, is transmitted to the force output means 8 by a non-positive or a positive coupling effect, such means accordingly moving toward each other in the direction 16 of the tension force. The activated condition produced in this fashion is indicated in chained lines in FIG. 1 at 17.

The contractile hose could also have a different structure in order to produce a different operational characteristic.

During actuation the structures and/or components secured to the force output means 8 are shifted in relation to each other so that the desired effect is produced.

The contractile hose 2 is characterized by having a customized or specially adapted form of its terminal regions 5 and 6. This will be explained in more detail with reference to the terminal region 5 depicted on the left in FIG. 1. The other terminal region 6 is preferably identically designed. However, there is also the possibility of only designing one of the terminal regions with this particular configuration.

Figure 2:
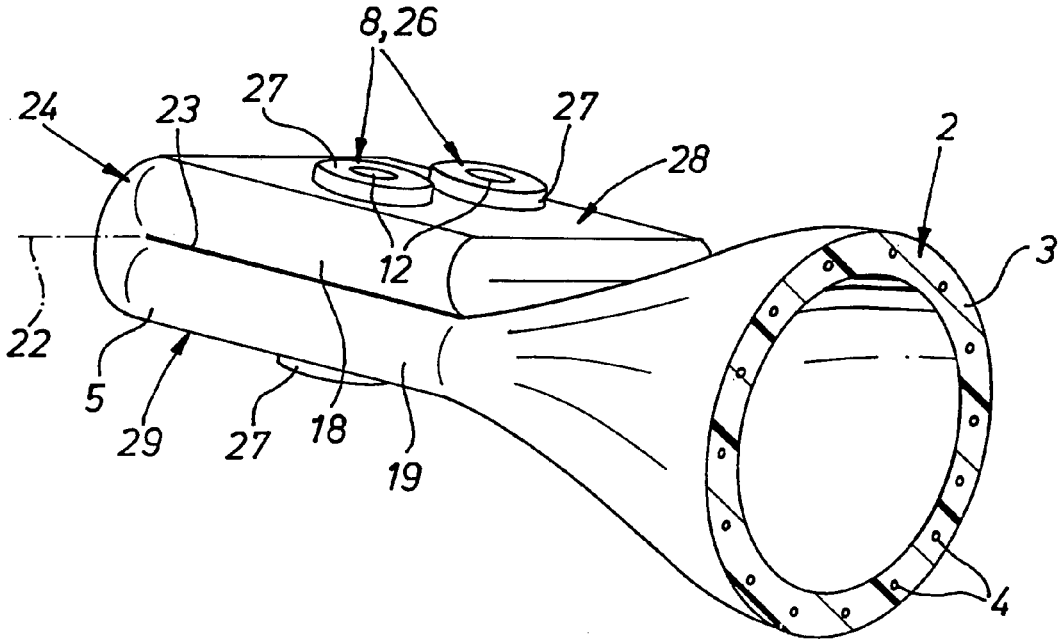
FIG. 2 is a perspective elevation on a larger scale of the portion marked II in FIG. 1 of the contractile drive.
Figure 3:
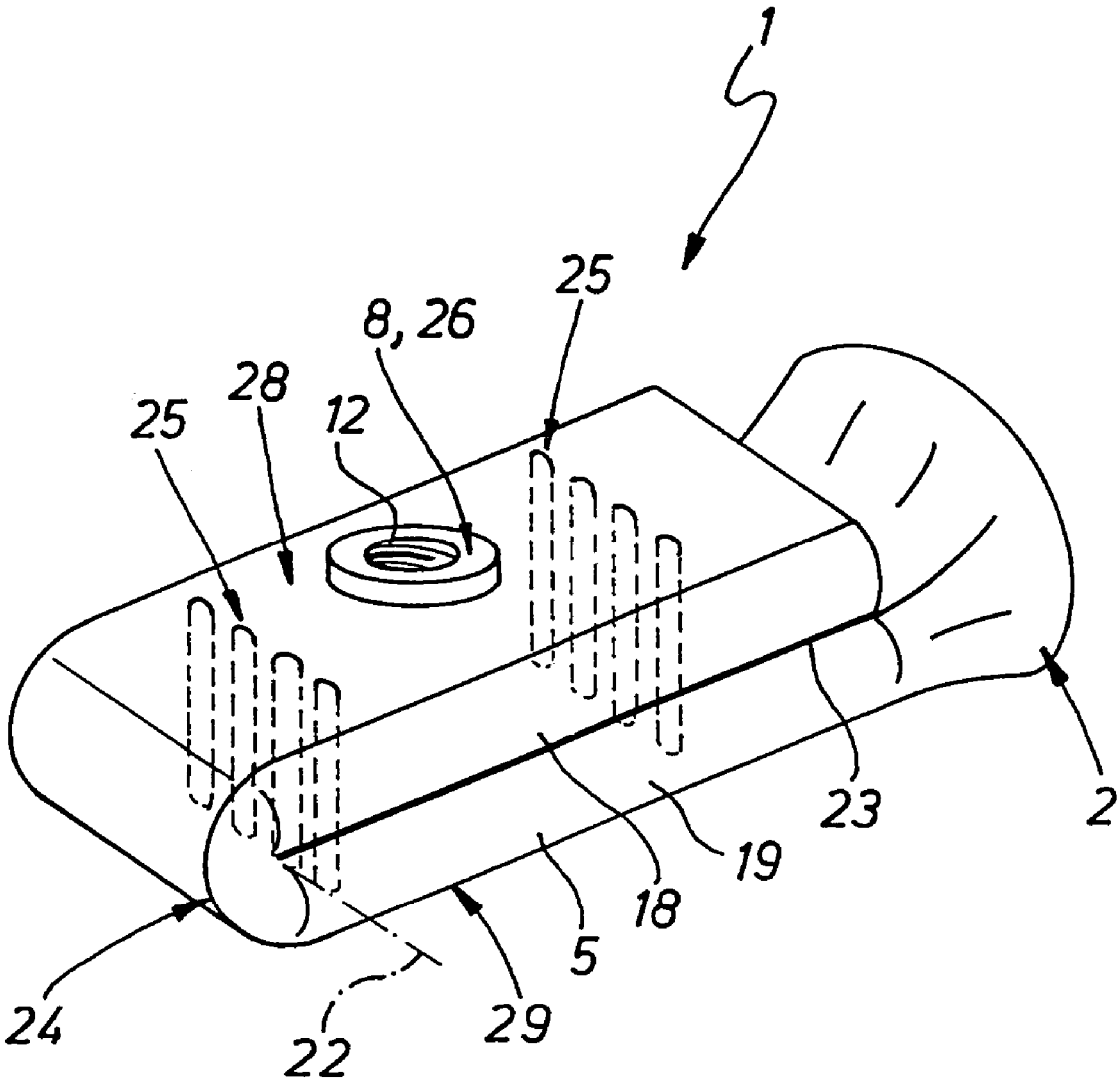
FIG. 3 shows a terminal section of an alternative design of the contractile drive, again in a perspective view.

The above particulars and the following particulars also apply for the modified design illustrated in FIGS. 2 and 3 unless anything is said to the contrary.

The contractile hose 2 has a flat shape at its terminal region 5. This form is more particularly produced by squeezing the contractile hose 2, originally having a circularly cylindrical configuration, from either side at its terminal region so that diametrally opposite hose wall sections 11*a* and 11*b* have their inner faces thrust against each other preferably over large areas.

At the said terminal region 5 the contractile hose 2 is bent over. The line 22 of bending or folding indicated in chained lines in FIGS. 2 and 3 extends at a right angle to the longitudinal axis 15 and at the same time in parallelism to the plane of extent of the flat terminal region 5. It could be said that the respective terminal region 5 of the contractile hose 2 is bent back.

There is at least one folded back part, and preferably there is only one such fold. In any case such folding over means that at least two hose sections 18 and 19, each with a flat configuration, of the terminal region 5 assume positions adjacent to each other, preferably with a parallel alignment. These hose sections 18 and 19 are firmly connected together by suitable means.

Preferably the hose sections 18 and 19, of which in the working example there are two, produced by folding or bending over make flat engagement with one another at the facing sections of the outer faces. The preferably at least substantially plane zone of contact is identified by reference numeral 23 in FIGS. 2 and 3.

Owing to such direct at the fold 24 a sharp bend is produced in the longitudinal extent of the contractile hose 2. The bend means that the contractile hose 2 is pinched and sealed in a fluid-tight fashion so that the desired sealing off of the actuation space 7 from the surroundings is ensured.

In order to hold the structure in the bent over position in the case of the design in accordance with FIG. 2 the adjacent hose sections 18 and 19 are bonded together in the zone 23 of contact. Alternatively a weld joint would be possible.

In the working embodiment illustrated in FIG. 3 instead of a bond and/or weld there is a sewn connection or seam 25. Using suitable stitching measures with at least one sewing thread with a sufficient tensile strength in this case the two adjacent hose sections 18 and 19 are firmly sewn together. The seam extends through the zone 23 of contact athwart the longitudinal direction 15 of the contractile drive 1.

In addition an adhesive can be applied at the terminal region 5 in the interior of the contractile hose so that the mutually engaging wall areas of the contractile hose 2 are also bonded together in the interior in order to further optimize the seal and the coherence of the structure.

It is in this case an advantage if the hose sections 18 and 19, arranged adjacent to each other owing to bending over (and which in the working example are on top of each other) are firmly pressed together. Suitable clamping means for this purpose may be the sewing thread or threads possibly employed for the seam 25.

In all working embodiments illustrated the mutual pressing together of the adjacent hose sections 18 and 19 is produced exclusively or additionally by at least one connecting pin or bolt 26, which acts on the adjacently placed hose sections 18 and 19 athwart their longitudinal direction and by way of suitably shaped clamping heads 27 acts on the side faces 28 and 29 directed away from the area 23 of contact. In FIG. 3 only the clamping head 27 placed on the side face 28, which is directed upward.

The at the least one connecting pin 26 can be a screw or a compression rivet, the clamping heads 27 being constituted by the heads of such connecting elements.

FIG. 2 shows a design having a plurality of connecting pins 26 on the respective terminal region 5. Unlike this in the case of the working embodiment of FIG. 3 only one such connecting pin 26 is provided on the respective terminal region 5.

The connecting means described for mutually securing the hose sections 18 and 19 provided by the bending over or folding operation may be provided respectively separately or in combination with each other.

In all working embodiments the connecting pins 26 arranged at the respective terminal region simultaneously constitute the force output means 8. Since the connecting pins 26 extend through the hose sections 18 and 19 athwart the direction 16 of the tension force, there is an optimum interlocking or positive connection and accordingly reliable force transmission between the contractile hose 2 and the force output means 8. The force output means 12 may in this case be in the form of screw threads, which render possible a screw attachment of the structure or components which are to be braced and/or shifted.

Owing to the bending over technique there is furthermore a certain self-braking effect, since on operation of the contractile drive 1 the different layers of the hose wall have to move in opposite directions and may thus bear against the connecting pin.

The term "connecting pin" is only to mean connecting elements, which extend through adjacently placed hose sections. Their cross section does not have to be circular as in the working embodiment.

In order to brace the hose sections 18 and 19 a staple arrangement could be placed around them. Same could also be a component of the force output means 8.

Departing from the design depicted in the drawing it is possible for the terminal regions 5 and 6 to be bent over several times so that more than two hose sections are adjacent to each other. Bending over once leading to two adjacent hose sections 18 and 19 is however regarded as being particularly advantageous.

Between the adjacently placed hose sections 18 and 19 an intermediate part could be arranged, by which the hose sections 18 and 19 are then braced as a further advantage. Such an intermediate part could be a component of the force output means 8.

The invention claimed is:

1. A fluid power contractile drive comprising a contractile hose, wherein upon a fluid actuation of an actuation space delimited by the hose a longitudinal contraction thereof takes place and whererin the hose's two terminal regions are adapted to be provided with a force output means rendering possible output of the drive force produced, characterized in that the contractile hose has a flat configuration at least at one terminal region and is bent over, the hose sections arranged adjacent to each other owing to the bending of the hose sections of the contractile hose being firmly connected with each other by a bond or a weld, and the force output means associated with the at least one terminal region of the contractile hose possesses at least one connecting pin having a screw thread rendering possible output of force, the connecting pin extending through the adjacently placed hose sections while simultaneously connecting same.

2. The contractile drive as set forth in claim 1, characterized in that the adjacently placed hose sections rest flatwise against each other.

3. The contractile drive as set forth in claim 1, characterized in that the adjacently placed hose sections are firmly thrust together by clamping means.

4. The contractile drive as set forth in claim 1, characterized in that the adjacently placed hose sections are pinned together by means of at least one connecting pin extending through them.

5. The contractile drive as set forth in claim 4, characterized in that the at least one connecting pin is constituted by a screw or a rivet.

6. The contractile drive as set forth in claim 1, characterized in that the force output means associated with the at least one terminal region of the contractile hose is interlockingly connected with such terminal region.

7. The contractile drive as set forth in claim 1, characterized in that the contractile hose possesses a hose body including a rubber elastic material and a tensile fiber arrangement which is coaxial in relation to the hose body and is embedded in the wall of the hose body.

8. The contractile drive as set forth in claim 7, characterized in that the tensile fiber arrangement comprises tensile fibers in a criss-cross array.

9. A fluid power contractile drive comprising a contractile hose, wherein upon a fluid actuation of an actuation space delimited by the hose a longitudinal contraction thereof takes place and wherein the hose's two terminal regions are adapted to be provided with a force output means rendering possible output of the drive force produced, wherein the contractile hose has a flat configuration at least at one terminal region and is bent over, the hose sections arranged adjacent to each other owing to the bending of the hose sections of the contractile hose being firmly connected with each other by a stitched seam connection, and the force output means is interlockingly connected with at least one terminal region of the contractile hose and possesses at least one connecting pin having a screw thread rendering possible output of force, the connecting pin extending through the adjacently placed hose sections while simultaneously connecting same.

10. The contractile drive as set forth in claim 9, wherein the adjacently placed hose sections rest flatwise against each other.

11. The contractile drive as set forth in claim 9, wherein the adjacently placed hose sections are pinned together by means of at least one connecting pin extending through them.

12. The contractile drive as set forth in claim 11, wherein the at least one connecting pin is constituted by a screw or a rivet.

13. The contractile drive as set forth in claim 9, wherein the contractile hose possesses a hose body including a rubber elastic material and a tensile fiber arrangement which is coaxial in relation to the hose body and is embedded in the wall of the hose body.

14. The contractile drive as set forth in claim 13, wherein the tensile fiber arrangement comprises tensile fibers in a criss-cross array.

15. A fluid power contractile drive comprising a contractile hose, in the case of which when there is a fluid actuation of an actuation space delimited by the hose a longitudinal contraction thereof takes place and wherein the hose's two terminal regions are adapted to be, provided with a force output means rendering possible output of the drive force produced, wherein the contractile hose has a flat configuration at least at one terminal region and is bent over, the hose sections arranged adjacent to each other owing to the bending of the hose sections of the contractile hose being firmly connected with each other, and wherein the force output means associated with the at least one terminal region of the contractile hose possesses at least one connecting pin extending through the adjacently placed hose sections while simultaneously connecting same, and the at least one connecting pin possesses a screw thread rendering possible output of force.

16. The contractile drive as set forth in claim 15, wherein the adjacently placed hose sections rest flatwise against each other.

17. The contractile drive as set forth in claim 15, wherein the force output means associated with the at least one terminal region of the contractile hose is interlockingly connected with such terminal region.

18. The contractile drive as set forth in claim 15, wherein the contractile hose possesses a hose body including a rubber elastic material and a tensile fiber arrangement which is coaxial in relation to the hose body and is embedded in the wall of the hose body.

19. The contractile drive as set forth in claim 18, wherein the tensile fiber arrangement comprises tensile fibers in a criss-cross array.

* * * * *